US005699573A

United States Patent [19]

Saalasti

[11] Patent Number: 5,699,573

[45] Date of Patent: Dec. 23, 1997

[54] METHOD AND PULP WASHING MACHINE FOR WASHING OF PULP OR ANY CORRESPONDING MATERIAL

[75] Inventor: Timo Tapio Saalasti, Espoo, Finland

[73] Assignee: Finbark Oy, Espoo, Finland

[21] Appl. No.: 433,326

[22] PCT Filed: Nov. 5, 1993

[86] PCT No.: PCT/FI93/00452

§ 371 Date: Jun. 30, 1995

§ 102(e) Date: Jun. 30, 1995

[87] PCT Pub. No.: WO94/10373

PCT Pub. Date: May 11, 1994

[30] Foreign Application Priority Data

Nov. 5, 1992 [FI] Finland ..... 924993

[51] Int. Cl.[6] ..... D06B 5/02

[52] U.S. Cl. ..... 8/156; 68/181 R; 162/60

[58] Field of Search ..... 68/98, 181 R, 68/43; 210/403, 404, 784; 162/60, 387, 295; 8/156; 100/116, 117, 118, 119, 120, 157

[56] References Cited

U.S. PATENT DOCUMENTS

| | | | |
|---|---|---|---|
| 49,088 | 8/1865 | Crerer et al. | 100/157 |
| 286,582 | 10/1883 | Borchard | 100/157 |
| 2,229,143 | 1/1941 | Stacom | 100/157 |
| 2,254,517 | 9/1941 | Fleming | 100/157 |
| 2,713,291 | 7/1955 | Cook | 100/157 |
| 3,086,454 | 4/1963 | Asplund | 100/157 |
| 3,199,441 | 8/1965 | Haug | 100/157 |
| 3,342,124 | 9/1967 | Frykhult | 100/157 |
| 3,695,448 | 10/1972 | Johansson | 210/403 |
| 4,215,447 | 8/1980 | Gartland | 8/156 |
| 4,286,512 | 9/1981 | Berggren . | |
| 4,292,123 | 9/1981 | Lintunen et al. | 162/60 |
| 4,355,573 | 10/1982 | Berry | 100/157 |
| 4,368,125 | 1/1983 | Murry | 210/403 |
| 4,986,881 | 1/1991 | Funk | 162/60 |
| 5,133,860 | 7/1992 | Tai | 210/403 |

*Primary Examiner*—Frankie L. Stinson

*Attorney, Agent, or Firm*—Birch, Stewart, Kolasch & Birch, LLP

[57] ABSTRACT

In the pulp washing machine and method therefor, pulp to be washed is fed between the rotating drum and the pressing roll inside it, so that pulp passes along a spiral-formed track around the pressing roll, being thereby pressed several times. Washing liquid is fed to the pulp at one or several points along its track of movement, between the pressings and/or at the pressing position. Washing thus takes place partly as a diffusion and partly as a displacement washing process. Washing is efficient and reduces the breaking of pulp fibers down to a minimum.

17 Claims, 3 Drawing Sheets

METHOD AND PULP WASHING MACHINE FOR WASHING OF PULP OR ANY CORRESPONDING MATERIAL

The invention relates to a pulp washing method used to remove chemicals dissolved in liquids, for example in connection with chemical or mechanical pulp washing or bleaching processes, or to replace the chemicals contained in a liquid. The invention also relates to a pulp washing machine for carrying out this method.

BACKGROUND OF THE INVENTION

The known washing methods belong to the categories of diffusion washing, displacement washing, and pressing. Diffusion washers often are drum filters, boosted either by vacuum or pressure. A displacement step using showers is often added to them. Displacement washers, are either drums, wire machines or towers. In all washers, the washing liquid generally moves in the counter-current direction in relation to the pulp to be washed. The desired washing water consumption is 2 to 2.5 cubic metres of water per one dry pulp ton. In order to reach a sufficiently good washing result, for example, four washing filters in series, or a multiphase drum displacement washer are often used. In principle, washing presses operate like pressure filters, than is to say, they remove liquid from pulp by pressure. Usually, these washing presses are either of a screw or a double roll type, but also drum presses have been tried.

Modern displacement towers and displacement drums are very efficient washing machines and they can cope with the total washing needs of the production line, even alone, but, on the other hand, they also are very expensive and large units.

Due to their high prices and big sizes, displacement towers and displacement drums are not well suited for improving the efficiencies of existing washing lines. Washing filters can always be added in series to the line, but even this is relatively expensive and it also requires the installing of diluting devices and, in addition to this, the configuration as a whole will then form a relatively large unit.

Washing presses are often used to enhance the existing washing lines. However, the most efficient of the known presses suitable for this purpose, the screw presses, cut so much of the fibers when kneading them under pressure against the perforated housing and the screw flange that they cannot in general be used in the production of high quality chemical pulp. Double roll presses again are expensive but, on the other hand, very efficient devices by which an approximately 1 per cent pulp can be dried to an about 40 per cent dry matter content.

The one-phase drum presses used to press pulp do not break the fibers and they would be suitable, also as far as their prices are concerned, to enhance the existing washing lines but they have not appeared efficient even when improved by a displacement step brought about by pumping. Pumping washing liquid evenly through a pressed pulp layer has turned out to be difficult and inefficient, and most often the displacement step has been omitted.

SUMMARY OF THE INVENTION

The object of the invention is to eliminate these difficulties, that is to say, to create a simple, very reliably operating and sufficiently efficient washing device that will not break fibers and, despite of that, is so cheap that it can be used to enhance existing washing lines. Further, the aim of the invention is the possibility to use the washing device in special situations as a press to dry pulp, for example, for provisional storage.

The idea of the invention is to use the press for drying wood wastes, known as such, so that a detergent is fed to the pulp once or several times as it is running through the rotating drum, between the drum and the pressing roll inside it.

The basic machine can, for instance, be a press according to Finnish Patent 62330. According to the invention, washing liquid feeding means will be added to the machine in suitable positions along the pulp feeding track. The detergent is advantageously fed to the pulp after every pressing step, whereafter washing liquid and all solid materials diluted in it will be removed by the next pressing step. Feeding the liquid to that side of the pulp layer that is farther away from the perforation results in a displacement effect, enhancing the washing procedure as such.

As the pulp under pressure, in the method according to the invention, does not move in relation to the pressing surfaces, the pressing operation will not break the fibers in the way a screw press does.

BRIEF DESCRIPTION OF THE DRAWINGS

In the following, the invention will be described in more detail, with references to the attached drawings illustrating one washing device structure, in connection of which a method according to the invention has been applied.

DETAILED DESCRIPTION OF THE INVENTION

Figure 1:
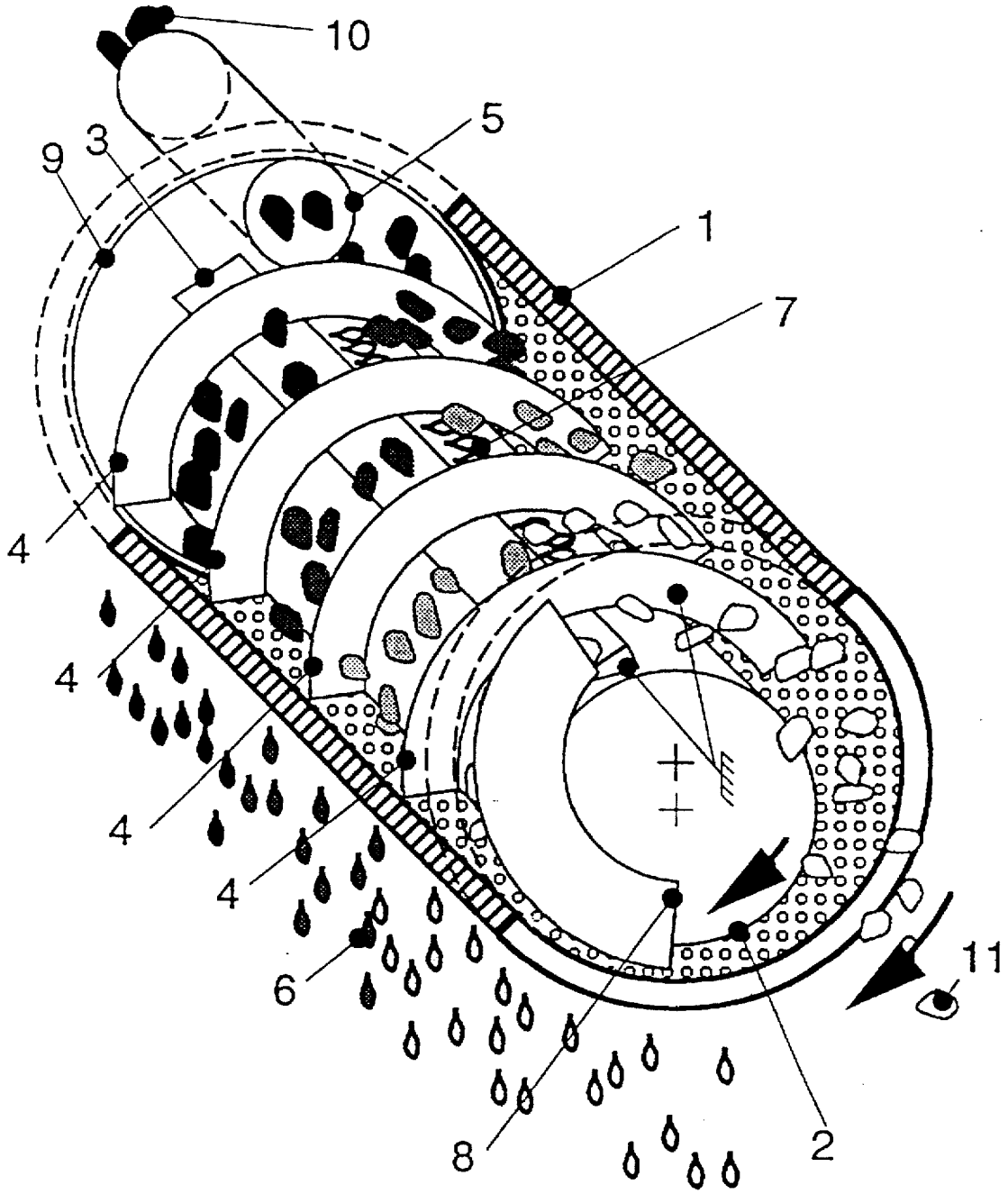
FIG. 1 shows a perspective of the washing device according to the invention, and in a partly cut form.

The washing device comprises a rotatable, perforated drying drum 1, a rotatable pressing roll 2, a liquid feeding means 3, integral with the machine body, and a solid guiding plate assembly 4 consisting of pieces of screw threads. In practice, the guiding plate assembly 4 is easiest to fix in the liquid feeding means 3, whereby they will form one integrated entity. It is advisable to make the guiding plate assembly 4 such that the perimeter of the plates runs so near the drum surface that it will at the same time remove all pulp possibly attached to it. The drum 1 and the pressing roll 2 rotate in the direction shown by the arrows. The pressing roll 2 is pressed downwards towards the drum surface so that the liquid will be pressed out from the pulp through the perforation of the drum 1. If so desired, also the roll 2 may be perforated. For other components than the feeding means 3, reference is made to above-noted Finnish patent.

The operation of the device has been illustrated by showing the incoming dirty pulp 10 by black and the outgoing washed pulp 11 by white and the intermediate phases in respective grey tones. The dirtiness of the liquid coming through the drum 1 is shown respectively.

The pulp to be washed 10 is fed to the washing device at the point 5. It is advantageous to feed the pulp coming from the preceding washing step without diluting, at least in 12 per cent consistency, in order not to increase the length of the drying drum excessively, or by using any suitable pre-drying method. The liquid is leaving pulp, and with it also some of the solid state matter, when it for the first time passes the pressing point between the roll 2 and the drum 1. If needed, the pulp can also be dried further by directing it several times through the pressing point, but in practice this is seldom necessary. Next, washing liquid 7 is added to the pulp by liquid feeding means 3. This liquid 7 flows to the pulp through the openings or holes in the trailing edge of the means 3 after every pressing movement, except the last pressing. Thus, it is advantageous to feed the liquid as near as possible to the surface of the pressing roll when it most likely will come to contact with the whole layer of pulp and, in addition to this, also drive the dirtier liquid, by displacing it, in forward direction and out from the pulp.

Figure 2:
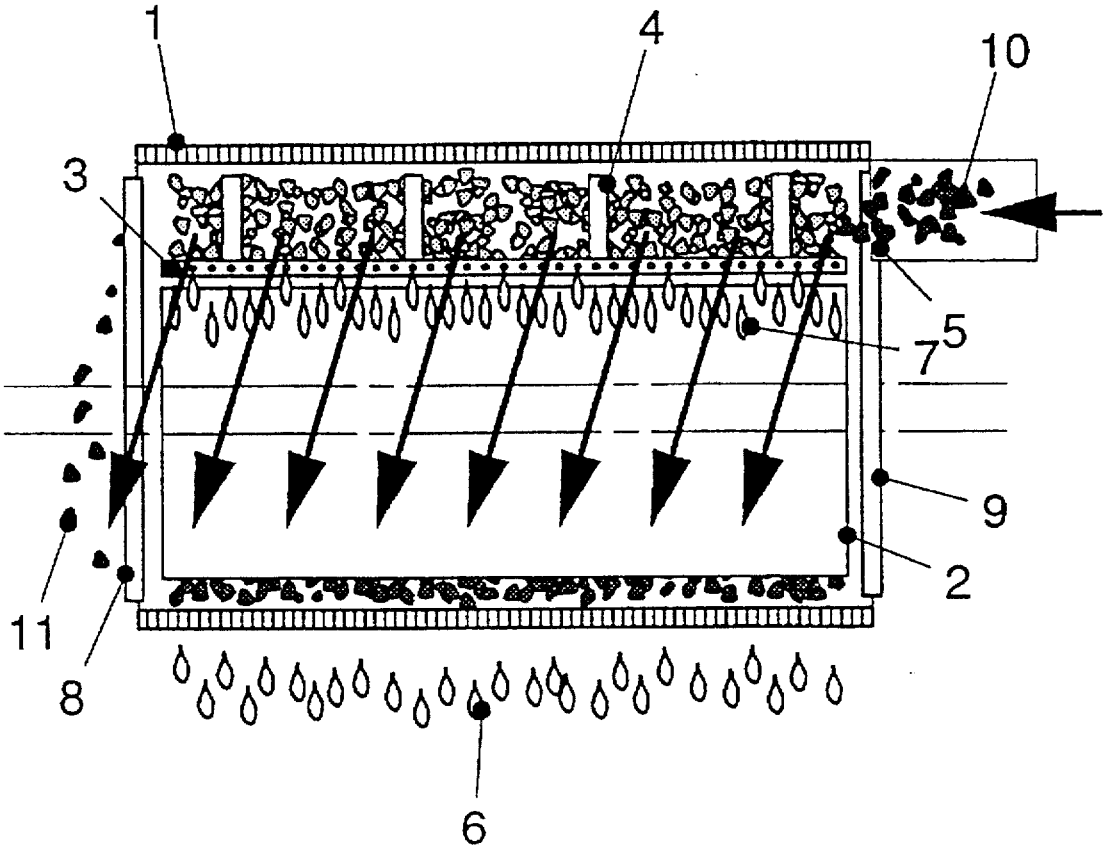
FIG. 2 shows a side view of the device, and in a partly cut form.

Pulp is moved in a longitudinal direction in relation to the drum (see the arrows in FIG. 2) by guiding plates 4 and, additionally, possibly by tilting the drum downwards in machine direction. After pressing, washing liquid is again added to the pulp and the operation will continue, as described above, as many times as determined by the drum 1 length and the pulp guiding plates 4. The last guiding plate 4 will at the same time push the pulp out from the machine. In practice, it is advantageous to close one end of the drum 1 by a non-rotatable cover plate 9, through the opening 5 of which the pulp is fed into the drum. If necessary, the outflow of pulp from the drum 1 can be limited by a solid or an adjustable output end cover plate 8, to maintain the drum uniformly filled by pulp.

The drum can also be tilted or even arranged vertical so that it is fed from the lower end. Then it is kept evenly filled, but a guiding plate assembly or corresponding is of course necessary.

The washing liquid 6 can be recovered at every pressing phase and pumped to the preceding phase by the counter-current principle. Alternatively, it is possible to use the crossflow principle, i.e. to use in the phase the same, equally fresh washing liquid, without recovering and recirculating it, as the washing is carried out at a fairly high consistency, depending on the conditions, between 15 to 30 per cent, whereby the consumption of washing liquid will diminish, anyway.

Figure 3:
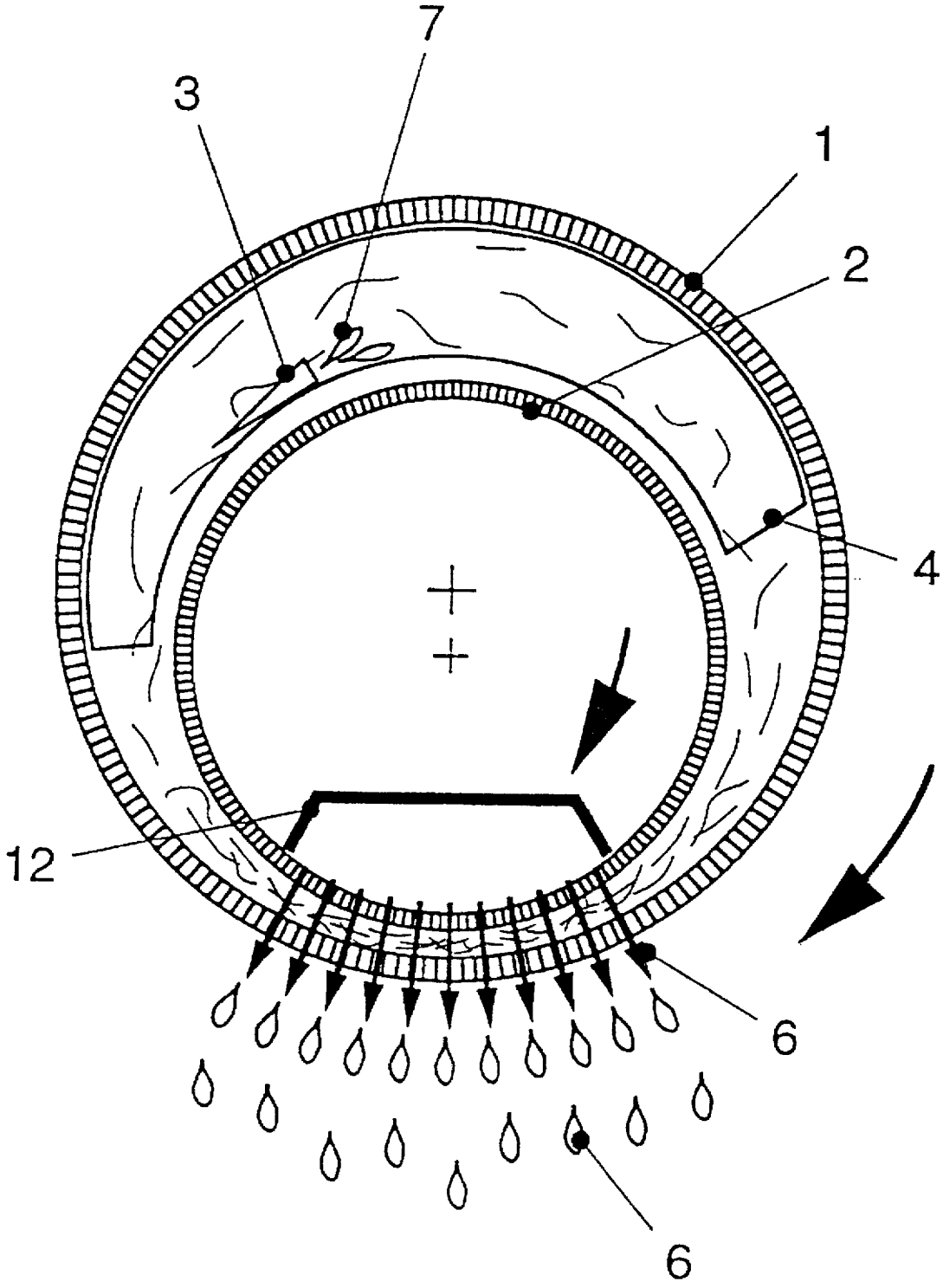
FIG. 3 shows a cross section of the device.

The washing liquid can, of course, also be fed no the pulp through the drum 1 or through the perforations of the pressing roll 2. Then the liquid feeding means 3 will, respectively, be outside the drum 1 or inside the pressing roll 2. In FIG. 3 there is a liquid feeding means constructed parallel to the drum 1 or to the axle of the roll 2, as an open elongated box 12 against the perforation of the roll, wherein the washing liquid pressure will be effective, and the periphery of which is sealed against the perforation of the roll like a suction box.

If desired, the drum can be partially submerged into a tank containing washing liquid. This provides the advantage that due to the compression in the lower part of the drum the drained washing liquid will not be directed to the ambient air bun directly into the liquid, which substantially eliminates foaming and the need for an antifoaming agent.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The advantages obtained by the present invention are significant:

As the washing itself is carried out at a fairly high consistency, the consumption of washing liquid will be very reasonable as compared with the washing result. The washing device can be constructed mechanically very resisting, as the liquid flows will be very small, compared with the filter and drum displacement devices operating with low densities, whereby no delicate wire surfaces are required, and, instead, thick steel pressing surfaces with bored or punched holes can be used. This kind of pressed pieces will never break unexpectedly and they will last longer. Sealing between moving and solid elements is easy, as the pulp at high consistency will not leak through the sealings so easily as the aqueous, low consistency pulp, whereby, for example, a simple and reliable labyrinth packing can be used. In special situations, pulp can be dried, after slopping the washing liquid feed, by simply pressing it, e.g., for provisional storage. In case other arrangements in the mill allow it, the whole washing line is possible to be constructed based on this kind of equipment, whereby there is no need at any of the steps to dilute the pulp more than for its boiling consistency, whereby also the amount of the liquid to be fed to the evaporation plant will diminish and contribute to savings.

I claim:

1. A method for washing pulp or any corresponding material, comprising the steps of:

transporting the material to be washed between a rotating drum (1) and a rotating pressing roll (2) inside the drum, in a direction along a longitudinal axis of the drum from one end thereof, at least one of the drum and the pressing roll being perforated, pressing the material to be washed a plurality of times between the drum and the pressing roll during the transporting step, and wetting the material to be washed with washing liquid at least at one position during the transporting step.

2. The method according to claim 1, wherein the wetting occurs at a plurality of positions along the longitudinal axis.

3. The method according to claim 2, wherein the wetting step includes supplying the washing liquid by liquid feeding means (3) arranged within the drum (1).

4. The method according to claim 2, wherein the wetting step includes supplying the washing liquid from outside the drum (1) which is perforated or from within the roll (2) which is perforated.

5. The method according to claim 1, wherein the wetting step includes supplying the washing liquid by liquid feeding means (3) arranged within the drum (1).

6. The method according to claim 1, wherein the wetting step includes supplying the washing liquid from outside the drum (1) which is perforated or from within the pressing roll (2) which is perforated.

7. The method according to claim 1, wherein the transporting step includes moving the material to be washed using a plurality of screw parts (4) disposed radially outward about an outer peripheral portion of the pressing roll (2).

8. The method according to claim 7, wherein the wetting step includes supplying the washing liquid from a liquid feeding means, wherein said plurality of screw parts are integral to said liquid feeding means.

9. The method according to claim 1, wherein the transporting step includes tilting the drum downwards in the direction of the transport of the material to be washed.

10. A pulp washing machine for washing pulp or any corresponding material, comprising a rotatable drum (1), a rotatable pressing roll (2) rotatably fitted within the rotating drum (1), at least one of the drum (1) and the pressing roll (2) being perforated, means for feeding material to be washed into the space between the drum and the pressing roll from an inlet to an outlet end of the drum, means for moving the pressing roll (2) towards an inner surface of the drum so as to provide a pressing point for the material between the drum (1) and the pressing roll (2), means within the space between the drum and the pressing roll for advancing the material, when the drum and pressing roll rotate, along a spiral-formed track structure extending around the pressing roll (2), from the inlet end of the drum to an outlet end thereof, and liquid feeding means (3;12) for feeding washing liquid onto the material to be washed in at least one position along said spiral formed track thereof.

11. The machine according to claim 10, wherein the liquid feeding means is adapted to supply washing liquid at several positions on the track of the material to be washed.

12. The machine according to claim 11, wherein the liquid feeding means (3) includes an elongated hollow structure extending within inside the drum (1), above the pressing roll (2), said structure having one or more discharge openings within the drum.

13. The machine according to claim 10, wherein said structure includes a plurality of solid screw parts (4) for transporting the material to be washed in a direction along an axis of the drum.

14. The machine according to claim 10, wherein the drum (1) and the pressing roll (2) are angled with respect to a horizontal line such that the inlet end is higher than the outlet end.

15. The machine according to claim 10, wherein the drum (1) and the pressing roll are angled with respect to a horizontal line such that the inlet end is lower than the outlet end.

16. The machine according to claim 10, wherein the outlet end of the drum (1) includes a cover plate (8) for limiting outflow therethrough.

17. The machine according to claim 10, wherein the drum (1) is partly submerged into the washing liquid.

* * * * *